US007134577B1

(12) United States Patent
Verma

(10) Patent No.: US 7,134,577 B1
(45) Date of Patent: Nov. 14, 2006

(54) PLASTIC LINED METALLIC LIQUID DISPENSER

(76) Inventor: Satish Verma, 2557 Indian Creek Rd., Diamond Bar, CA (US) 91765

( * ) Notice: Subject to any disclaimer, the term of this patent is extended or adjusted under 35 U.S.C. 154(b) by 244 days.

(21) Appl. No.: 10/861,819

(22) Filed: Jun. 3, 2004

(51) Int. Cl.
*B65D 88/54* (2006.01)

(52) U.S. Cl. ..... 222/321.9; 222/95; 222/105; 222/321.7; 220/632

(58) Field of Classification Search ..... 222/321.7, 222/105, 321.9, 107, 383.1, 385, 92, 95, 222/94, 321.1, 321.2, 321.3, 626–638
See application file for complete search history.

(56) References Cited

U.S. PATENT DOCUMENTS

| | | | | | |
|---|---|---|---|---|---|
| 1,934,686 | A | * | 11/1933 | Frederick et al. | 220/4.01 |
| 2,038,760 | A | * | 4/1936 | Roselle | 222/107 |
| 2,205,875 | A | * | 6/1940 | Coffey et al. | 222/309 |
| 3,178,062 | A | * | 4/1965 | Welty et al. | 222/95 |
| 4,322,020 | A | * | 3/1982 | Stone | 222/95 |
| 4,423,829 | A | * | 1/1984 | Katz | 222/95 |
| 5,004,123 | A | * | 4/1991 | Stoody | 222/94 |
| 5,217,138 | A | * | 6/1993 | Nichols | 220/495.06 |
| 5,669,530 | A | * | 9/1997 | Cichon et al. | 222/153.09 |
| 5,752,629 | A | * | 5/1998 | Hardy | 222/189.09 |
| 5,759,654 | A | | 6/1998 | Cahill | |
| 5,865,350 | A | * | 2/1999 | Losenno et al. | 222/402 |
| 6,010,028 | A | * | 1/2000 | Jordan et al. | 220/669 |
| 6,123,234 | A | | 9/2000 | Lai | |
| 6,140,613 | A | | 10/2000 | Tsuno | |
| 6,194,043 | B1 | | 2/2001 | Fehn | |
| 6,588,629 | B1 | * | 7/2003 | De Pous | 222/182 |
| 6,651,845 | B1 | * | 11/2003 | Schroeder | 222/83 |

FOREIGN PATENT DOCUMENTS

| | | |
|---|---|---|
| JP | 55030963 | 3/1980 |
| JP | 61007034 | 1/1986 |

* cited by examiner

*Primary Examiner*—Frederick C. Nicolas
(74) *Attorney, Agent, or Firm*—Gordon K. Anderson

(57) ABSTRACT

A plastic lined metallic liquid soap dispenser (20) is formed consisting of a hollow metallic bottle (22) having a threaded neck, (24) and a plurality of separate metallic parts such as a bottom (26). A discrete plastic insert (38) is disposed within the hollow of the bottle (22), for isolating the metallic bottle from liquid soap stored within the dispenser to preclude a chemical reaction and/or contamination thereof if the metallic bottle is in intimate contact with liquid soap or the like. Connection means, in the form of threads or the like, join the bottle separate parts together around the plastic insert. Bottle access and closure means, including a hand pump (44), are attached to the threaded neck permitting the liquid within the plastic insert to be easily dispensed and to enclose the liquid for storage when not required for use.

13 Claims, 4 Drawing Sheets

PLASTIC LINED METALLIC LIQUID DISPENSER

TECHNICAL FIELD

The present invention relates to liquid containers in general. More specifically to a metallic container that incorporates a plastic insert within, to preclude detrimental chemical reaction of the liquid soap, or the like, stored in the container.

BACKGROUND ART

Previously, many types of containers have been used in endeavoring to provide an effective means to store and dispense liquids such as liquid soaps and lotions. The most common method is to coat at least part of the interior of the container with plastic or to spray plastic into a preformed outer shell.

A search of the prior art did not disclose any patents that possess the novelty of the instant invention; however the following U.S. patents are considered related:

| Patent Number | Inventor | Issue Date |
|---|---|---|
| 5,759,654 | Cahill | Jun. 2, 1998 |
| 6,123,234 | Lai | Sep. 26, 2000 |
| 6,140,613 | Tsuno | Oct. 31, 2000 |
| 6,194,043 B1 | Fehn | Feb. 27, 2001 |
| Japanese Patents: | | |
| JP55030963 | Tamai et al. | Mar. 5, 1980 |
| JP61007034 | Nakada et al. | Jan. 13, 1986 |

Cahill in U.S. Pat. No. 5,759,654 teaches an injection molded process for making multiple layer plastic structures. A plastic sleeve is placed in a mold with heated plastic forced against the sleeve. The sleeve is then bonded with the plastic forming an integral laminated structure.

U.S. Pat. No. 6,123,234 issued to Lai discloses a metal bottle with a depressible cap for pump dispensing of the contents formed of a main body with a cover. A resilient ring fits into an inner circumference of the cover and is supported by an annular hooked end from its lower side. The body has a recess which permits the hooked end to interface in a sealing manner. The inside of the main body and cap are not lined.

Tsuno in U.S. Pat. No. 6,140,613 teaches a sample container having a resin layer covering the entire inner surface of the metal container. The resin layer has a thickness of 10% or less of the thickness of the metal container. The resin layer on the inner surface of the metallic container is formed by a conventional method such a spraying or dipping.

U.S. Pat. No. 6,194,043 B1 issued to Fehn is for an all plastic container using post-consumer recycled plastic. The inner layer is formed of polypropylene with other coatings utilized as a covering and the outer layer is formed with post-consumer recycled plastic.

Tamai et al. in Japanese patent JP55030963 discloses a metallic bottle cover or, so called bottle cap, where molten polyethylene is forcibly inserted into the interior of the metallic bottle cover. A thin film portion is formed in the inner face of the cover to restrict foaming with a foamed packing portion formed annularly on the outer circumference of the thin film.

Japanese patent JP61007034 of Nakada et al. discloses a covered metallic bottle having a layer of thermodepositioned synthetic resin on the inner face of the upper portion of the bottle to improve efficiency of production. The upper portion of the bottle has a spout that is formed by bending the periphery of the opening of the spout to the outside overlapping flat against the outer surface. The upper body part is fitted to the outside of the container body and bonded. The bottom portion of the body is formed by drawing and ironing with no teaching of any synthetic resin on its inner face.

DISCLOSURE OF THE INVENTION

The invention is for a cast metallic bottle that is used to dispense liquids such as liquid soap or body lotion. While a cast metal bottle is highly desirable for its positive features it is possible that a chemical reaction could occur between the liquid and the metal. Since the invention is primarily used for liquid soaps, most soaps are highly corrosive and react with the metal in time, causing oxidation of the base metal creating a problem of contamination with flakes of rust transferred to the liquid or even to the extent that the opening could be plugging sufficiently as to render the container useless. Body lotions have a similar problem in that some chemicals in their makeup react with metal or in some cases the metal itself can leach into the lotion causing irritation and eventual damage to human skin. It is also possible that the metal leaching could change the visual appearance of the lotion which would be completely unacceptable to the user.

It is therefore a primary object of the invention to insert a semi-rigid plastic liner inside the cast or formed metal body of the bottle. Plastic is inherently inert to the material stored within and solves the substance reactive effect problem. The preferred plastic for use as the liner is low density polyethylene which is relatively pliable and has excellent chemical resistance along with its availability in a wide range of colors.

The metallic body of the bottle is either fabricated in two halves or has a removable bottom which allows the plastic liner to be inserted in between the halves or from beneath. Where the bottle has a removable metallic bottom enclosing the liner, a resilient base is added to the underside to both enclose the liner and to provide a protective non-scratching stand.

The material of the bottle may be cast aluminum, brass, copper, stainless steel, ferrous metals or the like. The metallic construction provides a solid robust container that presents an attractive exterior decor to the bathroom, bedroom or kitchen wherever liquid soap or lotion is utilized. The actual shape and size of the dispenser is almost unlimited as the type of product and interior decoration of the room is the governing intent with the shape blending in with the decor and spatial arrangement of the room. Many types of exterior finishes may be used to the cast metallic body such as polishing plating with gold, silver, brass etc. and anodizing aluminum.

Another object of the invention is that the use of a thermoplastic insert preserves the fragrance of the liquid stored inside which is highly advantageous to the user particularly when the liquid is transferred to the metallic bottle from the original container which is usually some type of thermoplastic.

Yet another object of the invention is that the metallic liquid container can be refilled and used over and over again as the pump or cap is easily screwed off and the replacement liquid may be poured in the opening.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figures 1, 2, 3, 4, 5, 6:
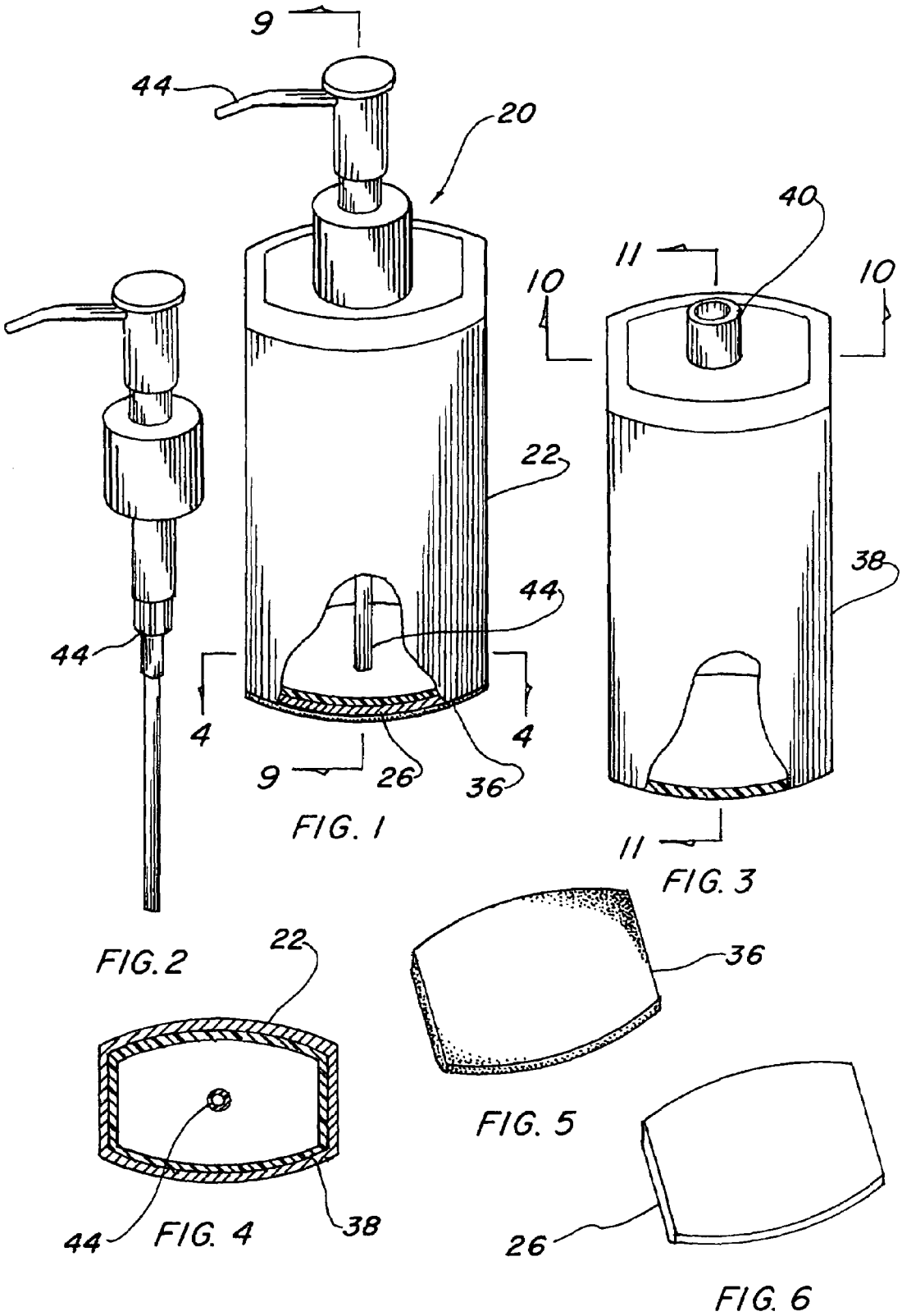
FIG. 1 is a partial cut away isometric view of the preferred embodiment including the liquid pump and resilient base.
FIG. 2 is a partial isometric view of the hand operated liquid pump completely removed from the invention for clarity.
FIG. 3 is a partial cutaway isometric view of the plastic insert of preferred embodiment completely removed from the invention for clarity.
FIG. 4 is a cross sectional view taken along lines 4—4 of FIG. 1.
FIG. 5 is a partial isometric view of the resilient base of the preferred embodiment completely removed from the invention for clarity.
FIG. 6 is a partial isometric view of the metallic bottom for the hollow metallic bottle completely removed from the invention for clarity.
Figure 7:
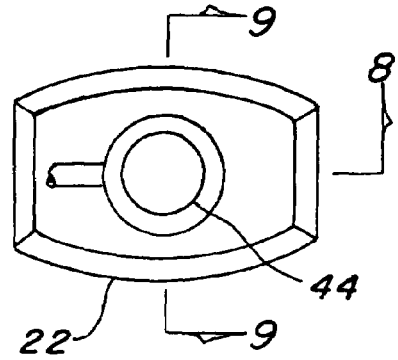
FIG. 7 is a top elevation view of the preferred embodiment.
Figure 8:
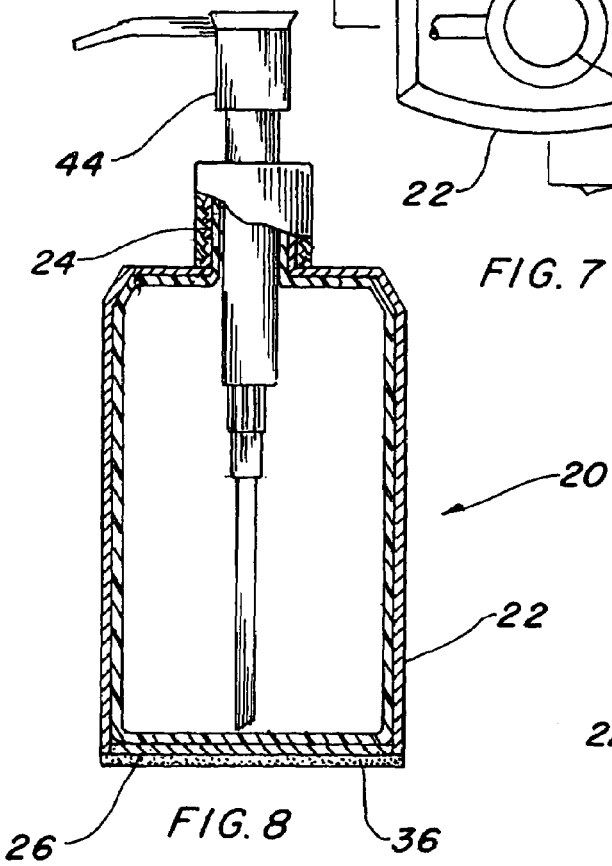
FIG. 8 is a cross sectional view taken along lines 8—8 of FIG. 7.
Figure 9:
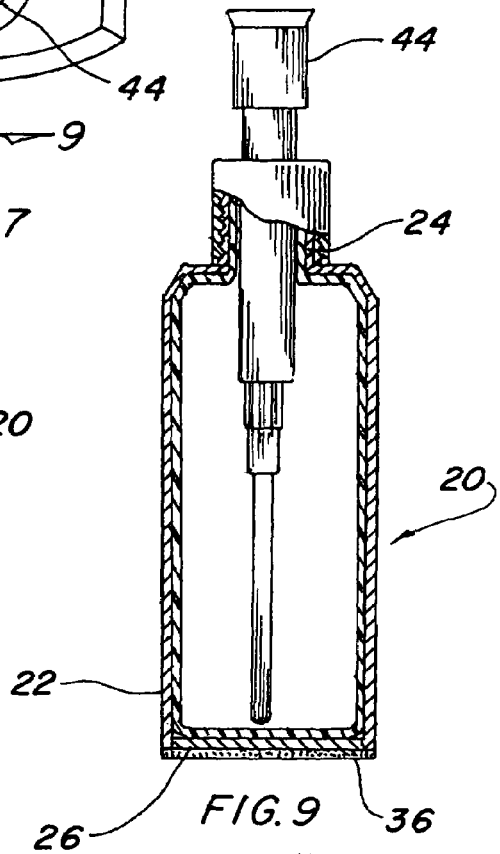
FIG. 9 is a cross sectional view taken along lines 9—9 of FIG. 7.
Figure 10:
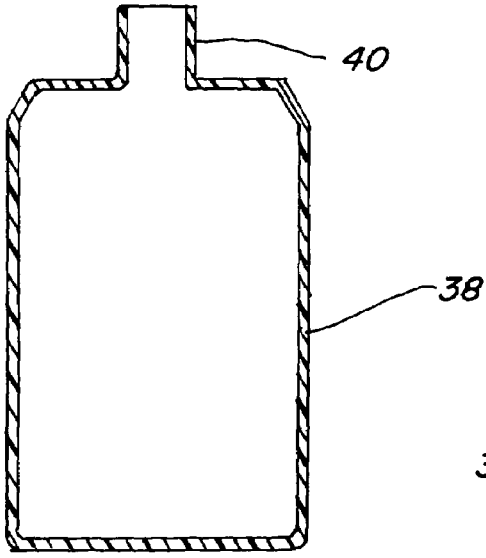
FIG. 10 is a cross sectional view taken along lines 10—10 of FIG. 3 illustrating the plastic insert by itself.
Figure 11:
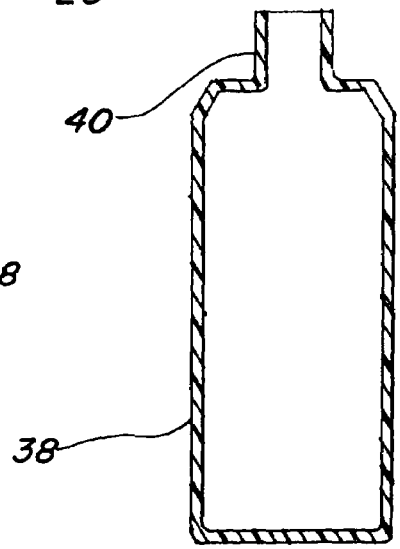
FIG. 11 is a cross sectional view taken along lines 11—11 of FIG. 3 illustrating the plastic insert by itself.
Figure 12:
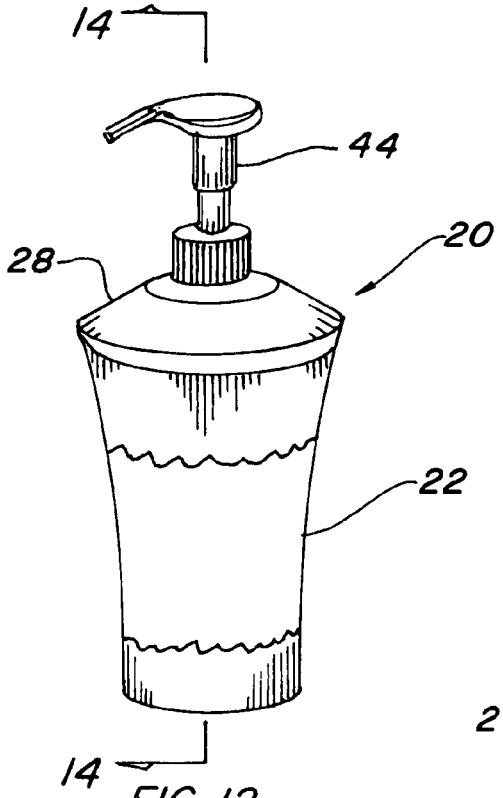
FIG. 12 is a partial isometric view of a second variation of the shape of the preferred embodiment.
Figure 13:
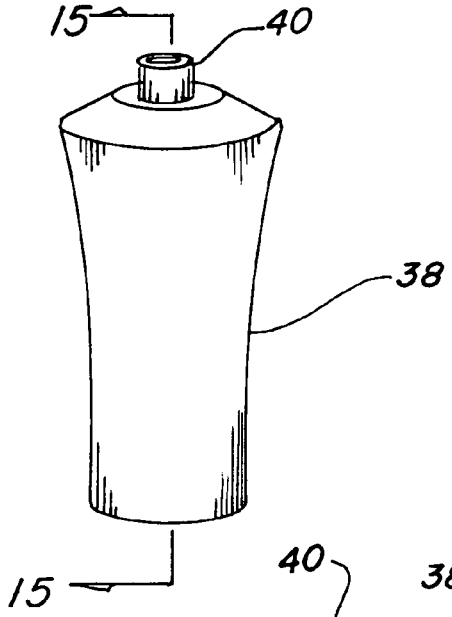
FIG. 13 is a partial isometric view of the second variation of the shape of the plastic insert shown removed from the metallic bottle for clarity.
Figure 15:
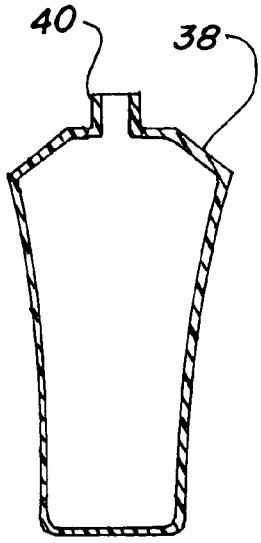
FIG. 15 is a cross sectional view taken along lines 15—15 of FIG. 13.
Figure 14:
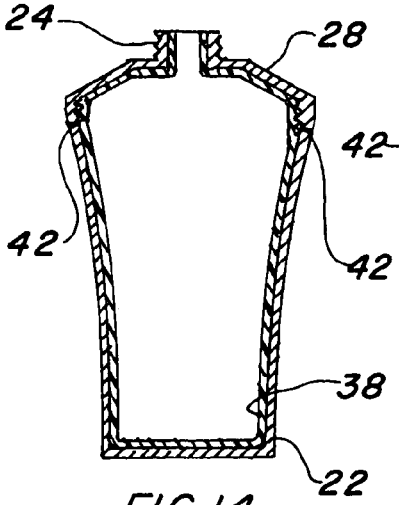
FIG. 14 is a cross sectional view taken along lines 14—14 of FIG. 12.
Figure 17:
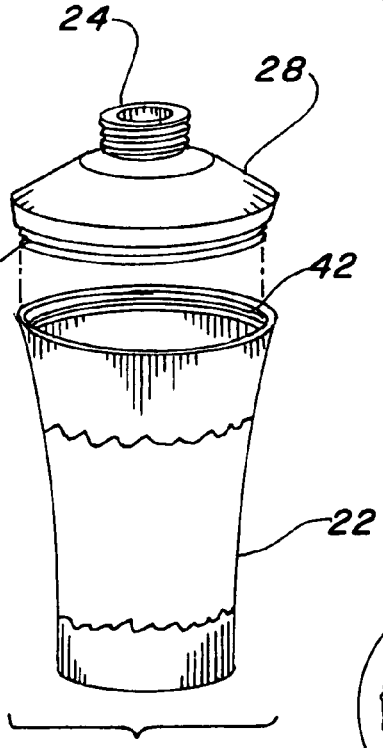
FIG. 17 is an exploded view of the hollow bottle of the second variation of the shape of the preferred embodiment illustrating the connection means in the form of threads.
Figure 16:
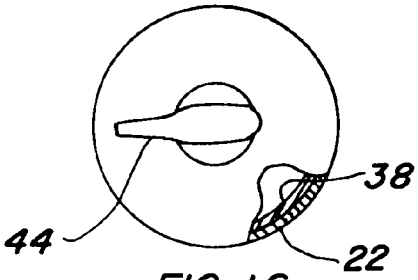
FIG. 16 is a top elevation view of the second variation of the shape of the preferred embodiment partially cut away to illustrate the interior construction.
Figure 18:
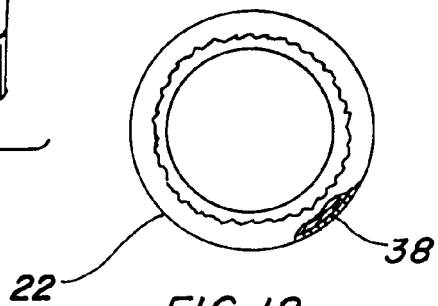
FIG. 18 is a bottom view of the second variation of the shape of the preferred embodiment partially cut away to illustrate the interior construction.

The best mode for carrying out the invention is presented in terms of a preferred embodiment with a variety of external shapes. The preferred embodiment of the plastic lined metallic liquid soap dispenser 20, along with a few of the different shapes, is shown in FIGS. 1 thorough 25. The invention is comprised of a hollow metallic bottle 22 having an integral threaded neck 24 protruding completely from the bottle 22. The bottle 22 is joined with at least one separable metallic part to form the dispenser. The dispenser 20 preferably has an ornamental decorative shape and possibly an additional enhancing exterior design on the bottle for furthering its ornate capabilities. FIGS. 1–11 illustrate a basic rectangular design with a removable bottom 26 while FIGS. 12–18 show a cast bottle 22 with a separate top 28 screwed together. FIGS. 19–25 depict an optional shape of the invention with a spun body 32 and a cast separate top 28. It will be noted that the shape, contour and construction of the dispenser 20 is not to be limited to the few illustrated, as innumerable shapes and designs are contemplated and only a sampling is shown while the actual shape is unlimited and yet the novelty of the invention is unaltered.

The hollow metallic bottle 22 may be formed casting liquefied metal into a mold. This casting procedure is accomplished by heating the base metal to its liquefied state in a controlled temperature furnace. An iron box, having two halves, is prepared with a pattern placed inside and sand is compressed around the pattern and gates. The pattern is then removed forming a cavity within the compacted sand and gates provide ingress into the cavity. Each half of the box is joined together and the molten metal is poured through the gates into the cavity. When the metal in communication with the sand solidifies on the contacting surface the balance of the molten metal is poured out leaving a hollow core. The box is then opened and the hollow bottle 22 is removed. The bottle 22 is deburred, filed, machined, threaded and a final buffing, polishing and ultrasonic cleaning is performed.

The casting of the bottle 22 may be made using a variety of materials such as aluminum, brass, iron, copper, bronze, stainless steel or ferrous alloys. The exterior finish on the casting may also be selective and may include electroplating, powder coating, painting, lacquering, anodizing, polishing and the like. The preferred metal is aluminum having a tensile strength of approximately 20,000 psi (1,406 kg/sq cm or brass having tensile s strength of approximately 30,000 psi (2,109 kg/sq cm).

The plastic lined metallic liquid soap dispenser preferably includes an external ornamental decorative shape and exterior design that is cast into the bottle 22 for enhancing its ornate capabilities.

Another embodiment variation of the plastic lined metallic liquid dispenser 20 is forming the metallic bottle 32 of a spinning from a flat sheet metal sheet of material. This method of construction is normally made using a thin sheet of stainless steel formed on a spinning machine using various male and female dies which stretches and forms the material into the desired shape and size. The balance of the bottle 32, such as the top 28, and sometimes a base is made of a casting fabricated in the same manner as previously discussed.

Figure 19:
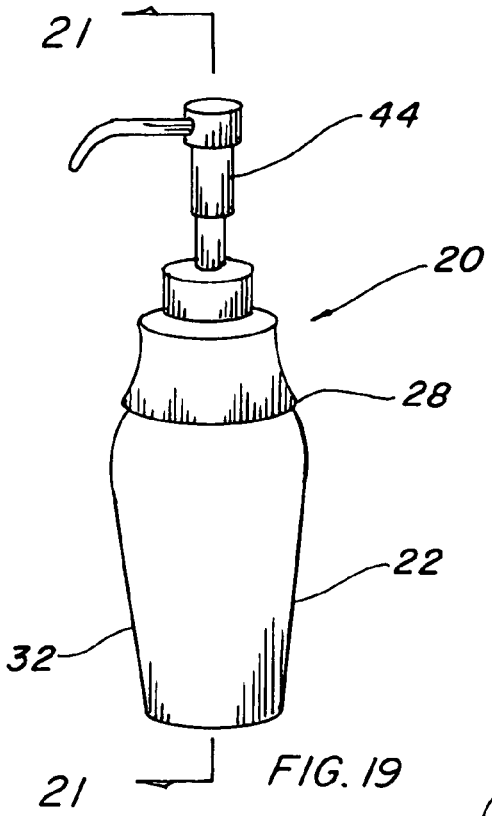
FIG. 19 is a partial isometric view of a third variation of the shape of the preferred embodiment.
Figure 20:
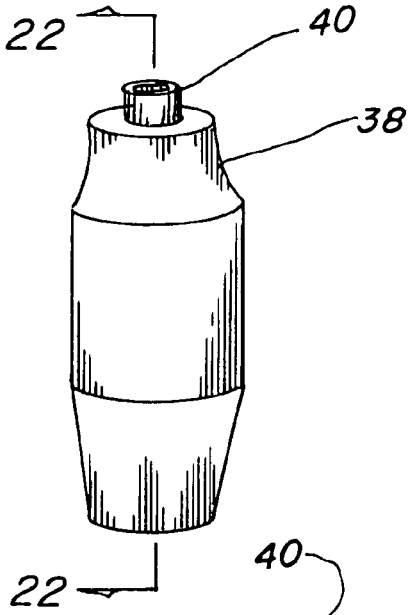
FIG. 20 is a partial isometric view of the third variation of the shape of the plastic insert shown removed from the metallic bottle for clarity.
Figure 22:
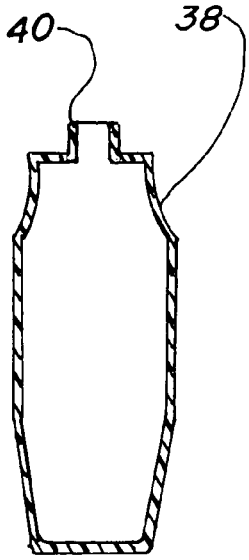
FIG. 22 is a cross sectional view taken along lines 22—22 of FIG. 20.
Figure 21:
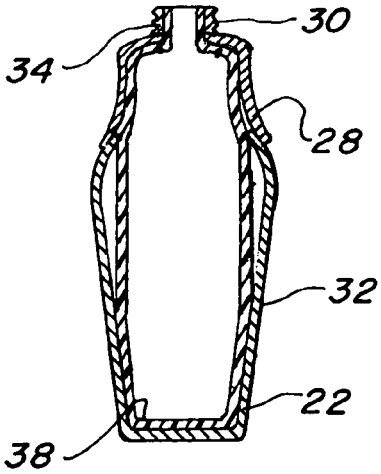
FIG. 21 is a cross sectional view taken along lines 21—21 of FIG. 19.
Figure 24:
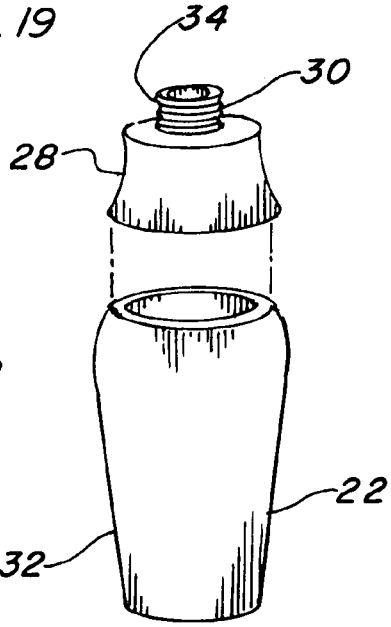
FIG. 24 is an exploded view of the hollow bottle of the third variation of the shape of the preferred embodiment illustrating the connection means in the form of adhesive.
Figure 23:
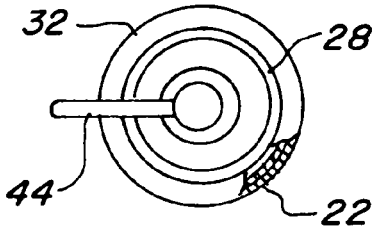
FIG. 23 is a top elevation view of the third variation of the shape of the preferred embodiment partially cut away to illustrate the interior construction.
Figure 25:
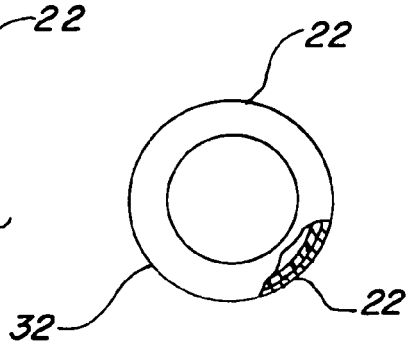
FIG. 25 is a bottom view of the third variation of the shape of the preferred embodiment partially cut away to illustrate the interior construction.

FIGS. 19–25 illustrate this embodiment variation with the spun metallic body 32 shown by itself in FIGS. 21 and 24. FIGS. 19, 23 and 25 depict the assembled dispenser 20 including the spun metallic body 32 and the separable top 28 with FIG. 24 disengaging the elements in the exploded view. It will be noted that a base for the spun metallic body is not illustrated however it is anticipated that any conventional base may be utilized and its attachment and configuration is well known in the art of decorative containers. If the spinning technique is used for the body 32 a separate neck 30 is required constructed with threads 34 on an outside surface and the separate neck 30 welded into place on the spun body 32. The separate neck 30 may be forged, cast or extruded with the threads 34 integrally formed or machined separately. Where the body 32 is spun and the separable top 28 is cast as illustrated in FIGS. 19, 21, and 24–25 connection means between the two are required and will be described in detail later.

If the bottle 22 is cast and includes an integral threaded neck 30 with its underside open, as shown in FIGS. 1–4, a removable bottom 26 is required. The bottom 26 in the preferred embodiment is shown by itself in FIG. 6 and assembled in FIGS. 1, 8, and 9 and may be cast metal or a flat sheet stamped into the desired shape. The attachment may be made by snapping the bottom 26 into place, pressing the elements together, using screws or by the use of some type of adhesive. Where the above construction is used, it is desirable to add a resilient base 36 attached to the dispenser 29 on a bottom surface, for cushioning the metallic dispenser and also to protect the surface upon which it is resting. Actually this base 36 may be used on any embodiment where it is desirable for its utility.

A discrete plastic insert 38 is disposed within the hollow of the bottle 22 for isolating the metallic bottle from liquid soap or other substances stored within the dispenser to preclude a chemical reaction and/or contamination thereof if the metallic bottle is in intimate contact with liquid substances. The plastic insert 38 is illustrated in FIGS. 1, 3, 4, 8, 9, 11, 13–15 and 20–22 and includes a hollow stem 40 protruding from a top surface of the insert 38 which is sized to fit into the neck 24 of the bottle 22. It will be noted that the hollow stem 40 extends completely above the neck 24 of the bottle 22, thereby preventing any contact with metal at all even when a closure, of some type, is connected to the metallic neck 24. The plastic insert 38 is fabricated as a blow molded liquid vessel having the size compatible with the inside surface of the metallic bottle 22 and is able to be slipped into the inside of the casting.

The blow molding process is well known in the art using blow molding machines. A metallic mold is made with a cavity the exact shape of the insert 38. The mold is mounted into the machine and thermoplastic granules are introduced into a hopper and heated until they are semi-solid and the plastic is positioned into the mold cavity. Pressurized air is introduced through pins inflating the molten material from the inside forcing the material, in balloon fashion, to contact the inner face of the mold where it solidifies and retains the desired hollow shape. While polyethylene (LDPE) is preferred other thermoplastics may be used such as polycarbonate, polypropylene, polystyrene, ABS, polyvinyl chloride or celluloses and the like. The Polyethylene has a specific gravity of from 0.912 to 0.925 and a tensile strength of from 1,200 psi to 1,800 psi (84.36 kg/sq cm to 126.54 kg/sq cm).

In order to assemble the elements, connection means are utilized for joining the bottle separable parts together around the discrete plastic insert 38 enabling the insert to be entirely enclosed, surrounded and completely isolated from the metal. These connection means may be in the form of threads, welding, brazing, using threaded fasteners, interference fit or using a myriad of adhesive types. FIGS. 12–18 illustrate threads 40 on the upper part of the bottle 22 and on the lower portion of the separable top 38. FIGS. 19–25 depict a bonded joint between the elements 32 and 38 using adhesive, whereas FIGS. 1–9 have a removable base snapped into place. It should also be noted that adhesive may be used between the plastic insert 38 and the bottle 22 to hold it securely in place and a sealant may be used at the interface of the neck 24 and stem 40 to assure hermetic integrity of the joint.

Bottle access and closure means are attached to the threaded neck 24 or 30 for permitting the liquid within the plastic insert 38 to be easily dispensed and to enclose the liquid for storage when not required for use. The bottle access and closure means include a hand operated pump 44, as shown in FIGS. 1, 2, 8, 9, 12 and 19. This pump 44 is well known in the art and is manufactured in considerably different styles and shapes all of which may be used in the invention with ease and prudence.

A threaded cap or pull-push closure sized to interface with the threaded neck 24 of the metal body 22 or the separate neck or 30 of the spun body 32 may be used as the closure means. These caps and pull-push closures are extremely common and in common use therefore are not depicted in the drawings.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A plastic lined metallic liquid soap dispenser comprising, a hollow cast metallic bottle having an upper body with an externally threaded neck and a bottom portion, each formed of separate metallic parts, a rigid discrete plastic insert disposed within the hollow of the bottle having the same basic shape as the hollow of the bottle and yet reduced in size sufficiently to fit inside without undo interference, for isolating the metallic bottle from liquid soap stored within the dispenser, to preclude a chemical reaction and/or contamination thereof if the metallic bottle is in intimate contact with the liquid soap, wherein said discrete plastic insert further comprises a hollow stem integrally molded in a to surface with the stem protruding completely from the neck of the bottle, connection means defined as a bottom joining said bottle separate parts together around the discrete plastic insert to entirely enclose and surround the insert, bottle access and closure means attached to the metallic bottle externally threaded neck contiguously engaging both the externally threaded neck external threads and said plastic insert hollow stem to permit the liquid soap within the discrete plastic insert, to be completely isolated from the metallic body, to enclose the liquid soap for storage when not required for use or to be easily dispensed, and said hollow metallic bottle and separate metallic parts further comprise an exterior finish selected from the group consisting of electroplating, powder coating, painting, lacquering, anodizing and polishing.

2. The plastic lined metallic liquid soap dispenser as recited in claim 1 further comprising an ornamental decorative shape and exterior design integrally formed into the bottle for enhancing its ornate capabilities.

3. The plastic lined metallic liquid soap dispenser as recited in claim 1 further comprising a resilient base attached to the bottle on said bottom portion for cushioning the metallic dispenser and also protecting a surface upon which the plastic lined metallic liquid soap dispenser is resting.

4. The plastic lined metallic liquid soap dispenser as recited in claim 1 wherein said hollow metallic bottle further comprises a metal having a tensile strength of from 20,000 psi to 30,000 psi (1,406 kg/sq cm to 2,109 kg/sq cm).

5. The plastic lined metallic liquid soap dispenser as recited in claim 1 wherein said hollow metallic bottle further comprises a material selected from the group consisting of aluminum and brass.

6. The plastic lined metallic liquid soap dispenser as recited in claim 1 wherein said hollow metallic bottle further comprises a material selected from the group consisting of aluminum, brass, iron, copper, bronze, stainless steel, and ferrous alloys.

7. The plastic lined metallic liquid soap dispenser as recited in claim 1 wherein said connection means selected from the group consisting of threads, welding, brazing, threaded fasteners, interference fit and adhesive.

8. The plastic lined metallic liquid soap dispenser as recited in claim 1 wherein said discrete semi-rigid plastic insert further comprises a material selected from the group consisting of polyethylene, polycarbonate, polypropylene, polystyrene, ABS, polyvinyl chloride and celluloses.

9. The plastic lined metallic liquid soap dispenser as recited in claim 1 wherein said bottle access and closure means further comprise a hand operated pump.

10. The plastic lined metallic liquid soap dispenser as recited in claim 1 wherein said bottle access and closure means further comprises a threaded cap sized to interface with the threaded neck of the metal bottle.

11. The plastic lined metallic liquid soap dispenser as recited in claim 1 wherein said bottle access and closure means further comprises a pull-push closure sized to interface with the threaded neck of the metal bottle.

12. A plastic lined metallic liquid soap dispenser comprising, a hollow cast metallic bottle having an upper body with an externally threaded neck and a bottom portion, each formed of separate metallic parts, a rigid discrete plastic insert disposed within the hollow of the bottle having the same basic shape as the hollow of the bottle and yet reduced in size sufficiently to fit inside without undo interference, for isolating the metallic bottle from liquid soap stored within the dispenser, to preclude a chemical reaction and/or contamination thereof if the metallic bottle is in intimate contact with the liquid soap, wherein said discrete plastic insert further comprises a hollow stem integrally molded in a top surface with the stem protruding completely from the neck of the bottle, wherein said rigid discrete plastic insert further having a specific gravity of from 0.912 to 0.925 sized to intimately engage an inside surface of the metallic bottle with the hollow stem protruding from a top surface such that a distal end of the stem is in contact exclusively with said connection means, connection means defined as a bottom joining said bottle separate parts together around the discrete plastic insert to entirely enclose and surround the insert, and bottle access and closure means attached to the metallic bottle externally threaded neck contiguously engaging both the externally threaded neck external threads and said plastic insert hollow stem to permit the liquid soap within the discrete plastic insert to be completely isolated from the metallic body, to enclose the liquid soap for storage when not required for use or to be easily dispensed.

13. A plastic lined metallic liquid soap dispenser comprising, a hollow cast metallic bottle having an upper body with an externally threaded neck and a bottom portion, each formed of separate metallic parts, a rigid discrete plastic insert disposed within the hollow of the bottle having the same basic shape as the hollow of the bottle and yet reduced in size sufficiently to fit inside without undo interference, for isolating the metallic bottle from liquid soap stored within the dispenser, to preclude a chemical reaction and/or contamination thereof if the metallic bottle is in intimate contact with the liquid soap, wherein said discrete plastic insert further comprises a hollow stem integrally molded in a top surface with the stem protruding completely from the neck of the bottle, wherein said discrete semi-rigid plastic insert is formed of low density polyethylene (LDPE) having a tensile strength of from 1,200 psi to 1,800 psi (84.36 kg/sq cm to 126.54 kg/sq cm), connection means defined as a bottom joining said bottle separate parts together around the discrete plastic insert to entirely enclose and surround the insert, and bottle access and closure means attached to the metallic bottle externally threaded neck contiguously engaging both the externally threaded neck external threads and said plastic insert hollow stem to permit the liquid soap within the discrete plastic insert, to be completely isolated from the metallic body, to enclose the liquid soap for storage when not required for use or to be easily dispensed.

* * * * *